United States Patent [19]

Kubis et al.

[11] 4,413,497

[45] Nov. 8, 1983

[54] METHOD OF FORMING DOMED END FOR CONTAINER

[75] Inventors: Charles S. Kubis, Weston, Conn.; John Walter, Evergreen Park, Ill.

[73] Assignee: Continental Can Company, Inc., Stamford, Conn.

[21] Appl. No.: 304,121

[22] Filed: Sep. 21, 1981

[51] Int. Cl.[3] ..... B21D 22/00

[52] U.S. Cl. ..... 72/356; 72/348; 72/361; 72/405; 413/22

[58] Field of Search ..... 72/356, 348, 361, 346, 72/404, 405; 413/8, 22, 53

[56] References Cited

U.S. PATENT DOCUMENTS 610,532 9/1898 Harmatta ..... 72/356

*Primary Examiner*—Francis S. Husar
*Assistant Examiner*—David B. Jones
*Attorney, Agent, or Firm*—Charles E. Brown

[57] ABSTRACT

A method of making a domed end for a container wherein a cup-shaped blank is initially formed and the blank has a skirt which terminates in a radially outwardly directed flange. This flange is utilized to support the blank and the resultant domed end throughout plural forming steps, and as a final forming operation, the flange is wiped down to form an extension of the skirt of the domed end with the skirt extension terminating in a narrow peripheral portion of the flange which now defines an out-turned lead-in portion for facilitating the telescoping of an open end of a can body within the skirt.

10 Claims, 11 Drawing Figures

METHOD OF FORMING DOMED END FOR CONTAINER

This invention relates in general to new and useful improvements in the forming of domed ends for containers, and most particularly relates to the initial forming from a flat sheet blank a cup-shaped blank having a radially outwardly directed annular flange which is utilized as a support for the domed blank in subsequent forming operations and later is re-formed to provide connecting means for attaching the domed end to a container body.

In accordance with this invention, a cup-shaped blank is formed from a flat sheet or blank so as to have a generally cylindrical skirt terminating in a radially outwardly directed flange. The so formed blank is transferred into a carrier wherein multiple cooperating tooling at a plurality of stations progressively shape the blank into a domed end for containers utilizing the flange as the sole support for the blank within the carrier. After the domed end has been formed, the flange is then re-formed so as to form means for securing the domed end to an open upper end of a container body.

In the formation of the domed end, the cup-shaped blank has a skirt of a preselected height, and this skirt is reduced in height during the forming operations and, at the completion of the doming operations, the flange is wiped down to form a continuation of the skirt.

In accordance with this invention, the overall height of the skirt of the domed end is the same as the height of the skirt of the cup-shaped blank and the wiping down may take place within a female die of the same configuration as the original die in which the cup-shaped blank was formed.

In accordance with this invention, the flange is not entirely wiped down, but a small peripheral portion thereof is permitted to remain and this provides an outturned lead-in portion for the domed end.

With the above and other objects in view that will hereinafter appear, the nature of the invention will be more clearly understood by reference to the following detailed description, the appended claims, and the several views illustrated in the accompanying drawings.

Figure 1:
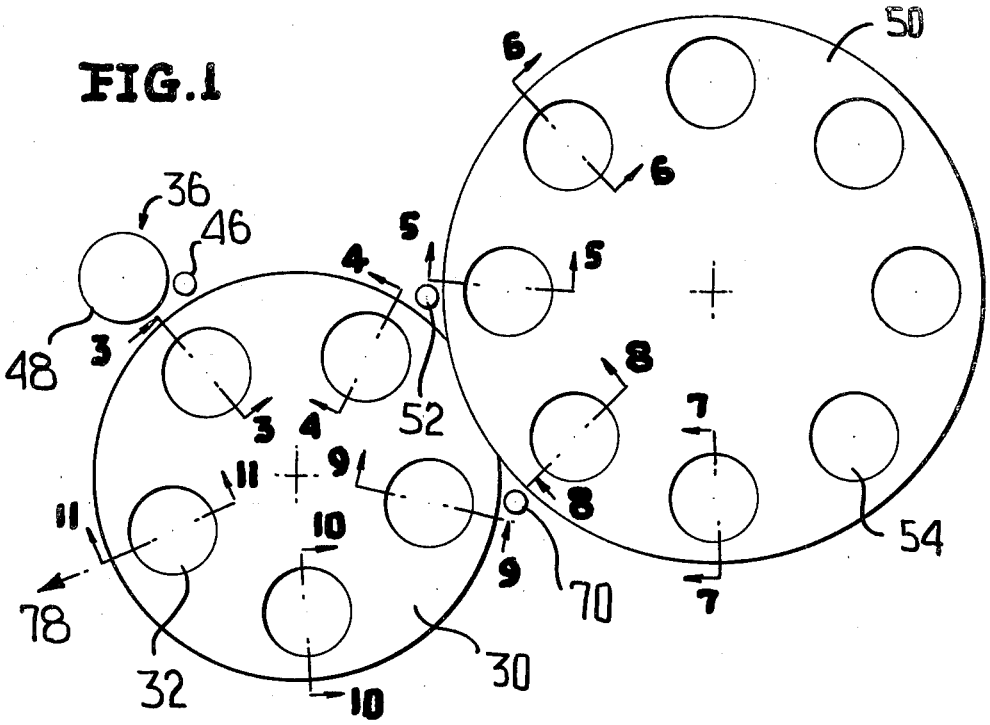
FIG. 1 is a schematic plan view of a mechanism for forming domed ends for containers and the like in accordance with this invention.
Figure 4:
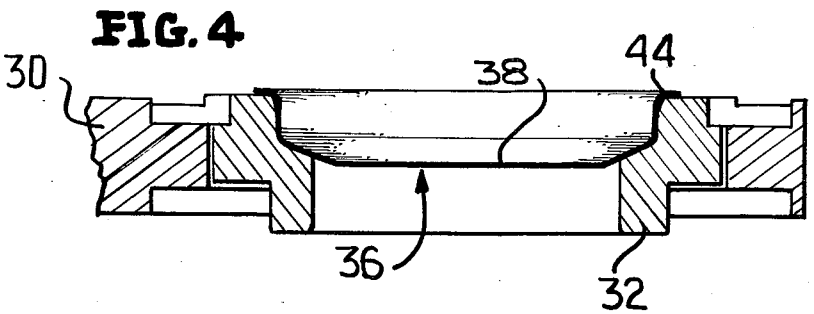

FIG. 4 is a sectional view on an enlarged scale taken generally along the line 4—4 of FIG. 1, and shows the sectional view through the first carrier at an idle station from which the cup-shaped blank is transferred to a transfer station of a second carrier to be operated on by tooling to effect the progressive shaping thereof into the domed end, and shows the manner in which the flange is utilized to support the cup-shaped blank.

Figure 5:
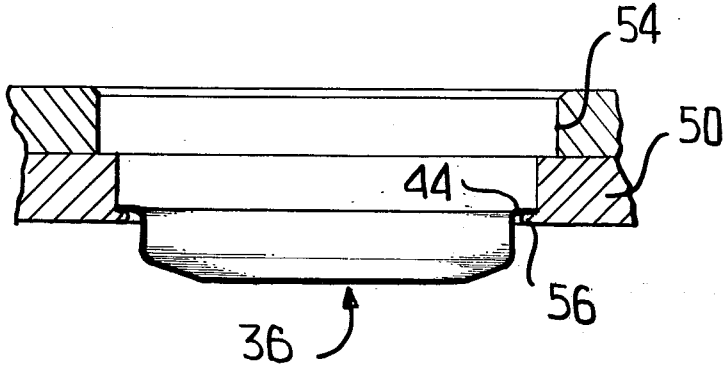

FIG. 5 is an enlarged fragmentary sectional view taken generally along the line 5—5 of FIG. 1, and shows a typical pocket configuration on the second carrier and the supporting of the cup-shaped therein by its flange.

Figure 6:
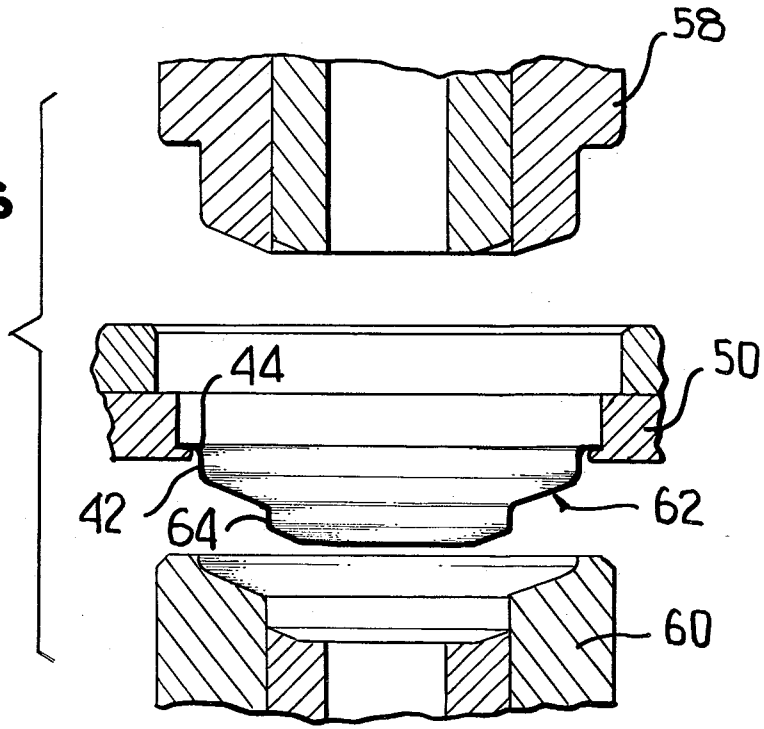

FIG. 6 is an exploded enlarged fragementary vertical sectional view taken generally along the line 6—6 of FIG. 1, and shows the blank after a first stage operation and the tooling for effecting the same.

Figure 7:
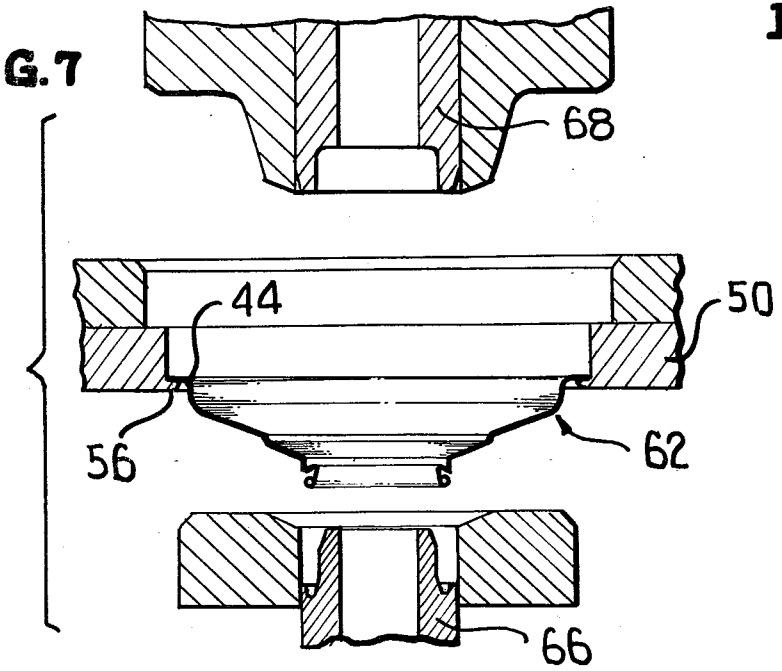

FIG. 7 is an enlarged fragmentary exploded sectional view taken generally along the line 7—7 of FIG. 1, and shows a curl forming station and the final tooling for progressively forming the blank into a domed end.

Figure 8:
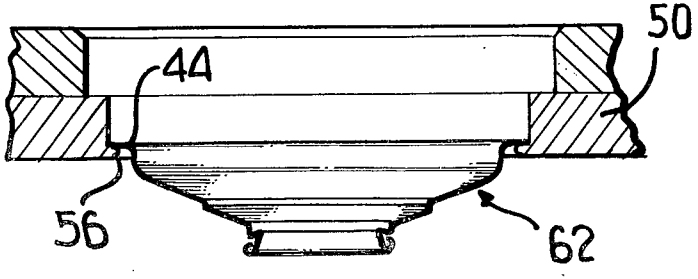

FIG. 8 is an enlarged fragmentary sectional view taken generally along the line 8—8 of FIG. 1, and shows the final configuration of the domed end at a transfer station of the second carrier.

Figure 9:
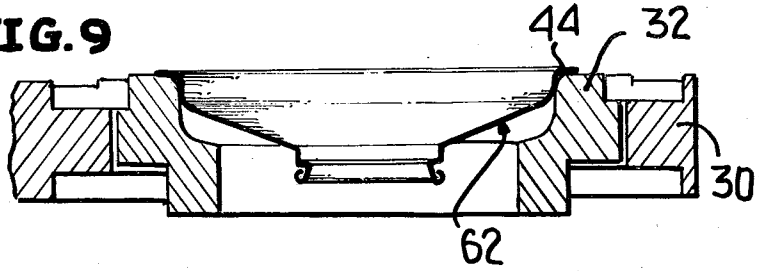

FIG. 9 is an enlarged fragmentary sectional view through the first carrier generally along the line 9—9 of FIG. 1, and shows the domed end still having thereon the support flange at a transfer station.

Figure 10:
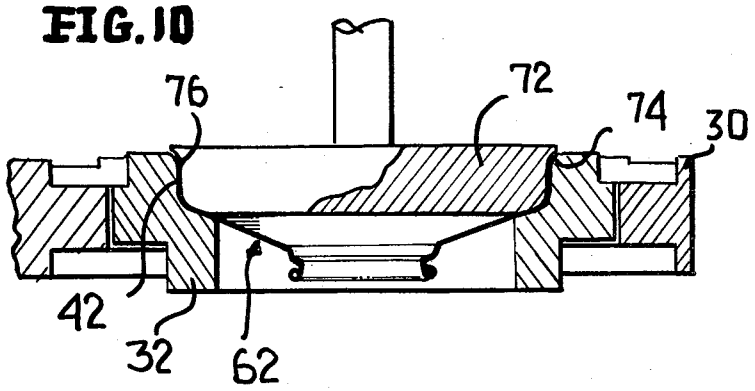

FIG. 10 is an enlarged fragmentary sectional view taken through the first carrier along the line 10—10 of FIG. 1, and shows the flange wiped down to form a continuation of the skirt of the domed end.

Figure 11:
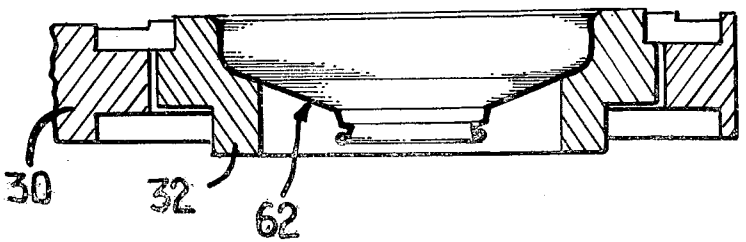

FIG. 11 is an enlarged fragmentary sectional view taken generally along the line 11—11 of FIG. 1, and shows the completed domed end at an unload station of the first carrier.

Figure 2:
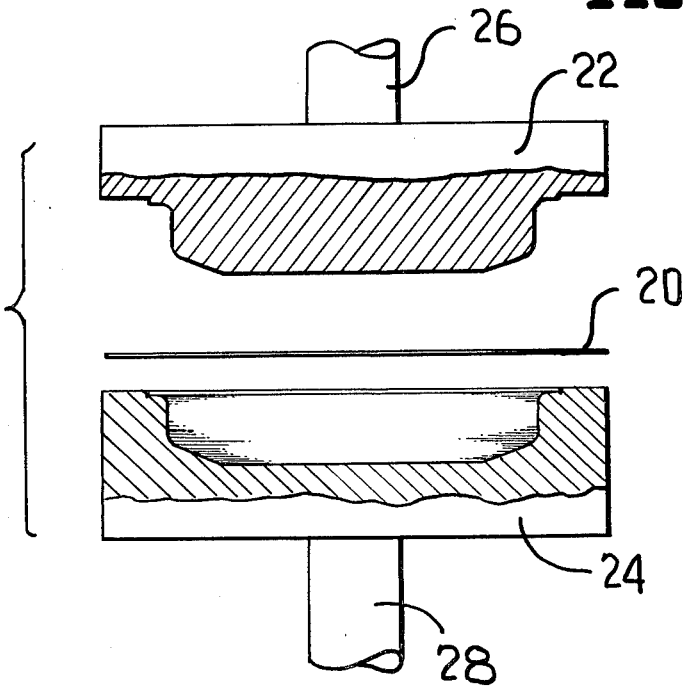
FIG. 2 is a schematic sectional view through tooling for forming a flat sheet blank into a cup-shaped blank having a radially outwardly directed annular flange.

Reference is first made to FIG. 2 wherein it will be seen that there is illustrated a flat circular sheet metal blank 20 positioned between a male die 22 and a female die 24 which are carried by movable support rods 26 and 28, respectively, for movement together to form the blank 20 into a generally cup-shaped blank having a generally cylindrical skirt and a radially outwardly directed annular flange. While a single circular blank 20 has been illustrated, it is to be understood that the tooling of FIG. 2 may be utilized with modification to form the cup-shaped blanks from a continuous strip, and more than one blank may be formed at a time if so desired.

Figure 3:
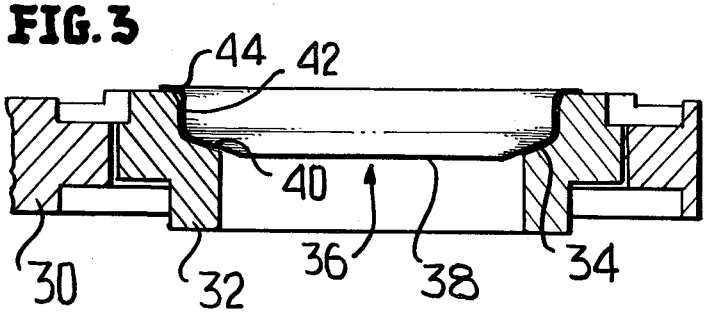
FIG. 3 is an enlarged fragmentary sectional view taken generally along the line 3—3 of FIG. 1, and shows the shape of a blank holder with the blank inserted therein at a load station.

Referring now to FIG. 3, it will be seen that there is illustrated a first station of a five station turret-type carrier 30 wherein at each station the carrier is provided with a support member 32. The support member 32 has a cavity 34 which corresponds to the cavity of the female die member 24 of FIG. 2. One of the aforementioned cup-shaped blanks, generally identified by the numeral 36, is seated in the cavity 34.

It will be apparent from FIG. 3 that the cup-shaped blank includes an end panel 38 which is joined by a radius 40 to a generally cylindrical skirt 42 which is provided at its free end with a radially outwardly directed annular flange 44. Each blank 36 is a separate element having a peripheral edge which is the final edge of both the blank 36 and the resultant domed end although its shape will be changed. Thus, the flange 44 has a free and final peripheral edge.

With reference to FIG. 1, will be seen that positioned adjacent station 1 of the turret-type carrier 30 is a stack of the cup-shaped blanks 36 which is arranged in a nested relation. Transfer means 46 which are only schematically illustrated, serve to transfer an uppermost blank 36 from the stack, identified by the numeral 48, to the support member 32 at station 1.

The carrier 30 is indexed so as to present the cup-shaped blank 36 to an idle station as shown in FIG. 4 for transfer to a second turret-like carrier 50 by means of a transfer mechanism identified by the numeral 52 and only schematically illustrated. It is to be understood that a cup-shaped blank 36 in the idle station 2 will be elevated and then moved into overlying relation to the carrier 50 where it will be lowered into one of a plurality of blank receiving sockets as is best illustrated in FIG. 5. With reference to FIG. 5, it will be seen that each socket 54 in the carrier 50 is of a stepped configuration and terminates in a lower lip 56 on which the flange 44 of the blank 36 seats, and this forms the sole support for the blank.

Reference is now made to FIG. 6, which illustrates an adjacent station of the second carrier 50 wherein the blank of FIG. 5 has been presented to opposed male tooling 58 and female tooling 60 to effect a first redrawing of the blank 36 in the initial formation of a domed end which will now be identified by the numeral 62. It will be seen that the domed end 62 has been foreshortened so as to reduce the height of the skirt 42 and the end panel 38 has now been provided with an enlarged domed portion 64.

It is to be understood that at other stations to which the partially formed domed end 62 is presented there will be other forming operations performed in a conventional manner forming no part of this invention and varying depending upon the specific configuration of the domed end 62. In FIG. 7 there is shown the details of a final forming operation on the domed portion of the domed end 62 in the form of a curl forming operation utilizing cooperating punches 66 and 68. It is to be noted that the domed end 62 is still mounted in its respective socket of the second carrier and is supported by its flange 44 on the lip 56. Thus, the flange 44 has served to support the cup-shaped blank domed end throughout its forming operations.

In FIG. 8, the formed domed end 62 is presented to a transfer station where a conventional transfer apparatus 70, schematically illustrated in FIG. 1, transfers the domed end 62 to a third station of the carrier 30 into one of the support members 32 thereof. At this time the domed end is supported in the support member 32 by way of the flange 44.

A fourth station of the carrier 30 is illustrated in FIG. 10, and shows the domed end 62 after a wipe-down operation wherein a plunger 72 forces the domed end 62 down into the socket of the support member 32 and in doing so reforms the flange 44 to define a generally cylindrical lower part 74 of the previously formed and foreshortened skirt 42 so that the domed end 62 in its final state has a skirt of substantially the same height as the orginal skirt 42.

The wipe-down operation of FIG. 10 is not a complete wipe-down operation in that a narrow peripheral portion of the flange 44 is not wiped down and now defines an out-turned lead-in peripheral portion 76 which will facilitate the entry of a cylindrical open end of a container body into telescoped relation with that portion of the skirt 74 formed from the flange 44.

In FIG. 11 the finally shaped domed end 62 is illustrated at a fifth station of the carrier 30 whereat it is ready to be ejected from the carrier 30 by an unloading mechanism schematically illustrated by the arrow 78 in FIG. 1.

It will be readily apparent from the foregoing that the forming of the cup-shaped blank including the flange 44 provides for ease of supporting of the blank during all dome forming operations thereon, and while the flange provides an adequate support, it in no way requires excess material in that the flange in a final operation is re-formed to form means for securing the domed end to an open upper end of a container body. It is to be understood that as far as this invention is concerned, the container body need only have a cylindrical upper end and that the domed end may be secured to the container body in sealed relation by any type of bonding means, although in the preferred embodiment of the invention an adhesive is utilized.

Although only a preferred method of making the domed end and only a preferred domed end configuration have been specifically illustrated and described herein, it is to be understood that minor variations may be made in the method of forming the domed end without departing from the spirit and scope of the invention as defined by the appended claims.

What is claimed as new is:

1. A method of forming a domed end for a container body, said method comprising the steps of initially shaping a flat blank to a generally cup-shaped blank having at its open end a radially outwardly directed surrounding flange with a free and final peripheral edge, utilizing said flange as a support for the end during subsequent forming operations, and then reshaping said flange for securement of said domed end to the container body.

2. A method according to claim 1 wherein the domed end has a generally cylindrical skirt of a preselected size and in the reshaping of said flange said flange is made cylindrical and a general continuation of said cylindrical skirt while maintaining constant the diameter of said skirt.

3. A method according to claim 1 wherein the domed end has a generally cylindrical skirt of a preselected size and in the reshaping of said flange said flange is made cylindrical and a general continuation of said cylindrical skirt while maintaining constant the diameter of said skirt by a wipe down operation.

4. A method according to claim 3 wherein said wipe down operation is incomplete and an outer peripheral portion of said flange is free of wipe down and defines an out-turned lead-in portion for facilitating the introduction of a free end of the container body into said skirt.

5. A method according to claim 2 wherein an outer peripheral portion of said flange is permitted to remain radially outwardly directed to form an out-turned lead-in portion for facilitating the introduction of a free end of the container body into said skirt.

6. A method according to claim 2 wherein the flat blank is formed in a female die to said generally cup-shaped configuration and wherein said generally cylindrical skirt is of a preselected height, in subsequent forming operations said generally cup-shaped blank is transferred to a carrier and while supported by said surrounding flange in the carrier by way of tooling separate from said carrier shaped to a domed configuration member with a resultant reduction of said skirt height, and thereafter said flange is reshaped by forcing the domed configuration member into a further female die of like configuration to the first mentioned female die in a wipe down operation.

7. A method according to claim 6 wherein said wipe down operation is incomplete and an outer peripheral portion of said flange is free of wipe down and defines an out-turned lead-in portion for facilitating the introduction of a free end of the container body into said skirt.

8. A method according to claim 1 wherein after said initial shaping of said flat blank to a generally cup-shaped blank, said cup-shaped blank is transferred to a carrier wherein said cup-shaped blank is supported and centered solely by said flange.

9. A method according to claim 1 wherein after said initial shaping of said flat blank to a generally cup-shaped blank, said cup-shaped blank is transferred to a carrier wherein said cup-shaped blank is supported and centered solely by said flange, and at least certain of said subsequent forming operations are effected utilizing separate punch and die sets.

10. A method according to claim 8 wherein said cup-shaped blank is initially transferred to a first carrier for transfer to the previously mentioned carrier, and after forming of the dome of said domed end the partially shaped domed end is returned to the first carrier for said reshaping of said flange in said first carrier.

* * * * *